US005083707A

United States Patent [19]

Holden

[11] Patent Number: 5,083,707

[45] Date of Patent: Jan. 28, 1992

[54] NUCLEATOR

[75] Inventor: Michael S. Holden, Williamsville, N.Y.

[73] Assignee: Dendrite Associates, Inc., New Hartford, Conn.

[21] Appl. No.: 487,861

[22] Filed: Mar. 5, 1990

[51] Int. Cl.[5] ..... F25C 3/04

[52] U.S. Cl. ..... 239/2.2; 239/14.2; 239/427.3; 239/428.5; 62/70; 62/74; 62/347

[58] Field of Search ..... 239/2.2, 14.2, 427, 239/427.3, 428.5; 62/69, 70, 74, 347

[56] References Cited

U.S. PATENT DOCUMENTS

| | | | |
|---|---|---|---|
| 3,464,625 | 9/1969 | Carlsson | 62/74 |
| 3,494,559 | 2/1970 | Skinner | 239/14.2 |
| 3,567,116 | 3/1971 | Lindlof | 239/14.2 |
| 4,813,597 | 3/1989 | Rumney et al. | 62/74 |
| 4,916,911 | 4/1990 | Duryea et al. | 62/70 |

FOREIGN PATENT DOCUMENTS

| | | | |
|---|---|---|---|
| 0932770 | 8/1973 | Canada | 239/14.2 |
| 0018280 | 10/1980 | European Pat. Off. | 239/14.2 |
| 2594528 | 9/1987 | France | 62/74 |
| 0981756 | 12/1982 | U.S.S.R. | 239/427.3 |

*Primary Examiner*—Robert P. Olszewski
*Assistant Examiner*—Christopher G. Trainor
*Attorney, Agent, or Firm*—Hayes & Reinsmith

[57] ABSTRACT

A method and apparatus for forming ice crystals for seeding an air-water mixture in making snow comprising an aspirator in communication with a first chamber, a second chamber connected to the first chamber through a first mixing tube, and a second mixing tube leading from the second chamber to an outlet. Low pressure air is introduced to the second chamber, and high pressure water is supplied to the aspirator to provide a high speed jet of water for evacuating air from the first chamber and driving a mixture of air and water droplets along the first mixing tube and into the second chamber wherein the mixture is accelerated by the flow of low pressure air through the second chamber and along the second mixing tube. A reverse flow of the low pressure air in the first mixing tube interacts with the jet of water to form a homogeneous mixture of water droplets and air in the first mixing tube, and the mixture in combination with more of the low pressure air is introduced to the second mixing tube wherein it is mixed, atomized and cooled by accelerated expansion as it flows along the mixture tube to form ice crystals leaving the outlet.

14 Claims, 2 Drawing Sheets

NUCLEATOR

BACKGROUND OF THE INVENTION

This invention relates to methods and apparatus for making "man made" snow and, in particular, to a new and improved method and apparatus for forming ice crystals for seeding water droplets in an air-water mixture generated in any apparatus for making snow.

The various techniques used for making "man made" snow in ski areas all rely on a mixture of water and air to form small ice crystals or snow flakes which have some of the characteristics of naturally occuring snow. In most, if not all cases, the techniques employed are not capable of making usable snow at temperatures at or near freezing without the introduction of nucleation sites around which freezing begins. This is due to a well-known phenomenon, whereby water droplets will not freeze, even at temperatures well below freezing, until the first ice crystal forms or is introduced. As soon as the first few crystals form, the freezing proceeds extremely rapidly. In snow making, guns where new water droplets are being constantly introduced, it is necessary to introduce necleation sites to trigger the snow making action if the ambient temperature is between 0° and 32° F. The most effective nucleation site is an ice crystal. There are also various substances that can substitute for the ice crystals to act as catalysts, but this introduces a third substance in addition to the water and air.

The most effective and efficient way to introduce these ice crystals or nucleation sites is by a so-called nucleator which utilizes only water and air. The nucleator produces smaller particles than a convential air/water gun because the key components are smaller in size and higher ratios of air to water are used. The nucleator is generally capable of making ice crystals at much higher temperatures than a basic air/water gun itself. The nucleator is located near the exit of the air/water of fan gun, so that the ice crystals are projected into the plume from the gun at an acute angle. For snow making devices where ice nuclei are not otherwise produced the results of this action are drammatic at temperatures at, or even slightly above freezing. When the nucleator is shut off the gun makes nothing but wet spray; when the nucleator turned on the gun it immediately starts making good snow.

There are a number of types of nucleators currently available, and in the case of the large fan type guns, as many as eight nucleators are used with each gun. However, all nucleators heretofore available require air pressure of 70 psig or greater to operate satisfactorily.

Recently, a new snow making gun has been developed which operates with an air pressure at or near 30 psig instead of 80 to 100 psig typical of all other air/water guns heretofore available. Low pressure operation has the advantage of reducing the energy cost for compressing the air to each unit to a fraction of the cost of operating conventional machines. But under some conditions, the low pressure gun, like the fan type machines, need a nucleator to initiate freezing of the water particles. Since no low pressure nucleators have been heretofore available, the use of a conventional nucleator would require a separate source of 80 psig air, as does fan gun, which greatly complicates and adds significant costs to the system.

Bearing in mind the foregoing and other deficiencies of the prior art, it is a primary object of the present invention to provide a new and improved method and apparatus for forming ice crystals for seeding water particles in snow making devices, which method and apparatus operates at significantly lower air pressures relative to prior nucleator design pressure.

It is a further object of the present invention to provide a method and apparatus for making tiny ice crystals (nuclei) which enhances the cooling effect of the compressed air on the tiny water droplets which formed therein.

It is a further object of this invention to provide a method and apparatus for making ice crystals which enhances the atomization of water droplets to produce the very small water and subsequently ice particles (nuclei).

It is another object of this invention to provide apparatus for making ice crystals which allows maximum internal flow and avoids erosion of internal parts.

It is yet another object of this invention to provide apparatus for making ice crystals which readily and easily installed and aligned on existing snow making apparatus.

It is still a further object of this invention to provide apparatus for making tiny ice crystals (nuclei) which is small in size, light in weight and includes easily interchangeable parts.

It is an important feature of this invention to develop small water droplets of a proper size and velocity to interact with low pressure as to form ice particles, which will provide nucleation sites.

Other objects will be in part, obvious and in part, pointed out in more detail hereinafter.

A better understanding of the objects, advantages, features, properties and relations of the invention will be obtained from the following detailed description and accompanying drawing which set forth an illustrative embodiment and is indicative of the way in which the principle of the invention is employed.

SUMMARY OF THE INVENTION

The present invention provides a method and apparatus for forming small ice crystals for seeding an air-water mixture in making snow comprising a water inlet in communication with a first chamber, a second chamber connected to the first chamber through a first stage mixing tube, a second mixing tube or nozzle leading from the second chamber to outside air, and means for introducing low pressure air to the second chamber. High pressure water is supplied to the mixing chamber to provide a high speed jet of water for partially evacuating air from the first chamber and driving a mixture of air and water droplets along the axis of the first mixing tube, and into the second chamber wherein the mixture is accelerated by the expansion of the flow of low pressure air into the second chamber and through the second nozzle. The reduced pressure in the first chamber, and the pressure of air in the second chamber, are utilized to create a counterflow flow in the first stage mixing tube which interacts with the jet of water to generate a homogeneous mixture of water droplets and air in the first mixing tube which is introduced to the second chamber wherein it is accelerated, mixed, atomized and cooled by non-adiabatic expansion of the low pressure air as it flows along the second nozzle to form ice crystals in the flow from the second nozzle. The low static temperature created in the high velocity air stream created by the pressure pressure drop in the second nozzle causes large heat transfer between the air and water droplets in the nozzle.

DETAILED DESCRIPTION OF THE INVENTION

In a basic method and apparatus for forming ice crystals for seeding an air-water mixture in a snowmaking apparatus, relatively high pressure air was utilized, (typically 80 to 120 psig), and mixing of air and water droplets to form ice crystals was done largely after the air had left the high pressure jets or orifices at the time that it was rapidly recovering its original temperature. Thus, there was little time to affect heat tranfer, and the driving potential that results from the adiabatic temperature drop which accompanies a sudden expansion is largely lost as the air molecules slow down outside the gun due to friction and turbulence on the jet as it interacts with the outer atmosphere. In the method and apparatus of the present invention, relatively low pressure air is utilized, (typically about 30 psig), and the low static temperature created by the high velocity and energy are utilized more efficiently in performing work on the water particles and increasing the heat transfer between the air and water in a nozzle of the apparatus while the air is still travelling at a high rate of speed.

Figure 1:
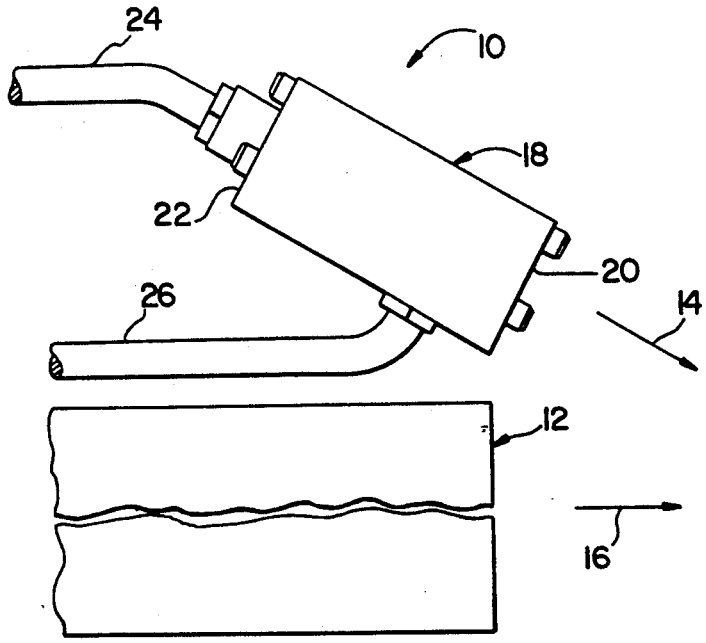
FIG. 1 is a side elevational view with parts removed illustrating a nucleator gun according to the present invention as it would appear in combination with snow-making apparatus.

FIG. 1 shows the apparatus 10 of the present invention, commonly designated a nucleator gun, as it would appear in use with snow making apparatus, the output portion of which is designated 12 in FIG. 1. Nucleator gun 10 produces a stream of ice nuclei (tiny ice particles) in the direction 14 which combines with the stream of air and water ejected from the snow making apparatus 12 into the atmosphere in the direction 16. The air water stream could also be produced by a fan-type reactive with the present invention, apparatus 10 operates with air supplied at a relatively low pressure, for example up to about 30 psig for efficient and effective use with snow making apparatus which operates at a similar low pressure, or in an "airless" fan machine. An example of such low pressure snow making apparatus is shown and described in pending U.S. patent application Ser. No. 271,163 filed Nov. 14, 1988 entitled "Snowmaking Process And Apparatus" and assigned to the assignee of this invention now U.S. Pat. No. 4,916,911 issued Apr. 17, 1990. Apparatus 10 includes an elongated body or housing 18 having an outlet at the one end 20 and an inlet at the opposite end 22 for receiving high pressure water from a supply line 24. Low pressure air is supplied to apparatus 10 by a line 26, and lines 24,26 are connected to the water and air supplies, respectively, associated with snow making apparatus 12.

Figure 2:
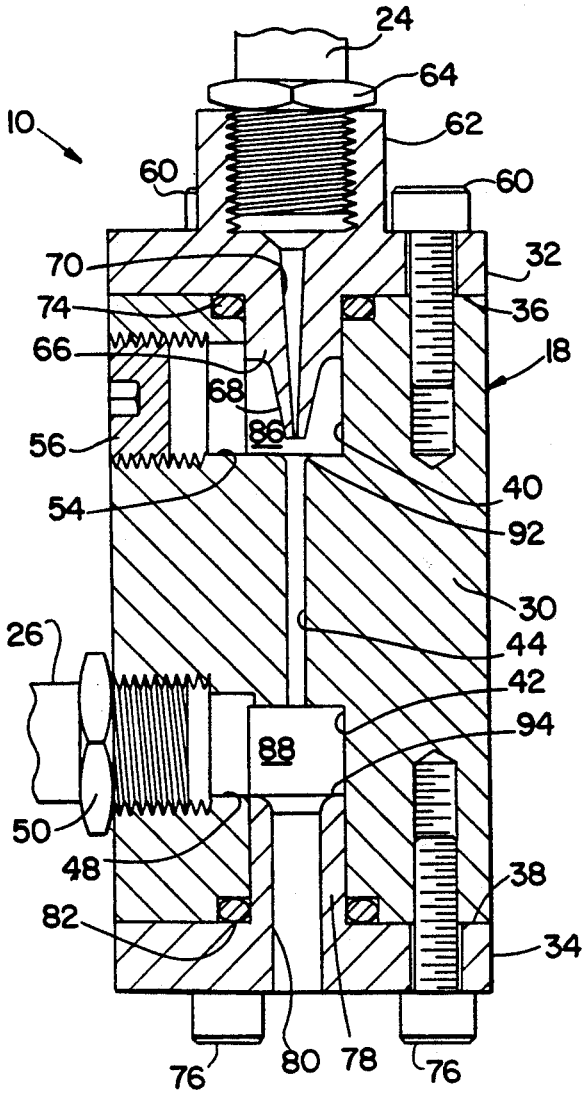
FIG. 2 is an enlarged longitudinal sectional view of the nucleator gun of FIG. 1.

Referring now to FIG. 2, the body 18 of nucleator apparatus 10 comprises three parts: a central or main body portion 30, an inlet end portion 32 and an outlet end portion 34. Central body portion 30 has opposite end faces 36, 38 disposed in planes substantially perpendicular to the longitudinal axis of body 18, a first central bore or passage 40 extending inwardly from end face 36 along a portion of the axial length of body portion 30, and a second central bore or passage 42 extending inwardly from the opposite end face 38 along a portion of the axial length of the body portion 30. Passages 40 and 42 are of substantially the same diameter, and are joined by a relatively smaller diameter bore 44 extending therebetween along the remainder of the axial length of body portion 30. Body portion 30 also is provided with a bore or passage 48 extending laterally inwardly to the inner end region of passage 42 for introduction of low pressure air. Passage 48 is threaded to receive a fitting 50 on the end of line 26 for connection to body 18. Body portion 30 can be provided with another bore or passage 54 extending laterally inwardly to the inner region of passage 40. Passage 54 is threaded to receive a removable plug 56 whereby passage 40 can be sealed from or open to the atmosphere.

Inlet end portion 32 of body 18 is in the form of a cap which is fastened to body portion 30 by a plurality of bolts 60 or the like. A central hub 62 extends from the outer surface of body portion 32 and is internally threaded to receive a fitting 64 on the end of water line 24 for connection to body 18. A central extension 66 on the inner surface of body portion 32 fits snugly in passage 40, extending along a section hereof, and terminates in a radially-inwardly tapering nozzle-like formation 68. A gradually converging small diameter passage 70 extends axially along body portion 32 from the interior of hub 62 to the tip of nozzle 68. An O-ring 74 is seated in an annular shoulder at the junction of passage 40 and surface 36 for providing a fluid-tight seal between body portions 30 and 32.

Outlet end portion 34 of body 18 is also in the form of a cap which is fastened to body portion 30 by a plurality of bolts 76 or the like. A central extension 78 on the inner surface of body portion 34 fits snugly in passage 42 and extends therealong, terminating adjacent the edge of passage 48. A constant diameter bore or passage 80 extends axially along body portion 34 from the outer surface thereof to the inner end of extension 78. An O-ring 82 is seated in an annular shoulder at the junction of passage 42 and surface 38 for providing a fluid-tight seal between body portions 30 and 34.

In the arrangement shown, body portions 30 and 32 defines a first chamber 86, body portions 30 and 34 define a second chamber 88, passage 44 is a first mixing tube having an inlet in fluid communication with chamber 86 and an outlet in fluid communication with chamber 88, passage 80 is a second mixing tube having an inlet in fluid communication with chamber 88 and an outlet, and nozzle 68 connected to the high pressure water supply line 24 is an aspirator means. The inlets of mixing tubes 44 and 80 are defined by smooth annular surfaces 92 and 94, respectively, each of gradually decreasing diameter in an inward axial direction. Mixing tube 44 is of greater axial length but of smaller diameter as compared to mixing tube 80. The outlet end or tip of nozzle 68 is located in chamber 86 and is spaced from the inlet of mixing tube 44. The outlet of mixing tube 44 is spaced from the inlet of mixing tube 80. In particular, the outlet of mixing tube 44 is on one end of chamber 88 and the inlet of mixing tube 80 is on the opposite end of chamber 88.

By way of example only, in an illustrative gun 10, the diameter of passage 70 adjacent the nozzle outlet is 0.022 inch, mixing tube 44 has a diameter of 0.066 inch and a length of 15/16 inch, and mixing tube 80 has a diameter of 0.200 inch and a length of 0.740 inch. The end of nozzle 68 is spaced 0.0695 inch from the inlet of mixing tube 44, and the outlet of mixing tube 44 is spaced 0.340 inch from the inlet of mixing tube 80.

In operation, nucleator gun 10 is positioned relative to the outlet end of snow making apparatus 12 as shown in FIG. 1, and the water and air supplied to the apparatus 12[1] also are supplied to gun 10. In particular, water at relatively high pressure, for example at least 300 psig or more, is supplied via line 24 and relatively low pressure air, for example up to about 30 psig, is supplied via line 26. Nucleator 10 emits ice crystals and cold air which seed the air/water mixture or plume emerging from snowmaking apparatus 12 to form snow.

1. Or water/air mixture from fan gun.

The function of the mixing tube is to brake-up the stream of water into small particles by the interaction of the co-flowing air and water streams.

In nucleator gun 10 of the present invention, in contrast to prior art nucleators, the first stage including water input provided by line 24 and the small diameter converging passage 70 associated with nozzle 68 is in effect an aspirator. A high speed jet of water issuing from the end of passage 70 having a diameter of 0.022 inch functions as a driver which evacuates the air in the first stage plenum 86. The mixture of air and water is driven into the small mixing tube 44 of 0.066 inch diameter and about 1 inch in length. The function of the mixing tube is to brake-up the water stream into small particles by the interaction of the counterflowing air and water streams. The mixture enters the second stage plenum 88 which is from a 30 psig source by line 26. The air/water mixture, plus the 30 psig air exists through the 0.200 inch rounded orifice 94 and the second 0.200 inch diameter mixing tube 80, about 0.75 inch long. The velocity of the air/water mixture entering the second stage plenum 88 is less than that of the air expanding from the 30 psig source velocity in the exit tube 80; however, an important feature is that the air velocity from the 30 psig supply at the end of the first stage mixing tube is coaxial and in close proximity to that of the water particles.

The nucleator 10 appears to work well in the mode where the first stage tap is completely closed-off by plug 56 as shown in FIG. 2. Although not confirmed by pressure measurement, the fact that nucleator 10 appears to act almost the same whether or not it is open to the atmosphere suggests that the pressure in chamber 86 may be close to atmospheric pressure. When nucleator 10 is operated with the first stage tap open, no water is emitted thereby indicating that the pressure is below atmospheric.

Thus, in the first stage mixing tube 44 the pressure is 30 psig at the tube exit and below atmospheric pressure at the tube entrance. It would appear that there is some counterflow occurring in the first stage mixing tube 44. The water and air mixture leave the first stage mixing tube 44 at a fairly high velocity, but slightly less than the 0.022 inch jet velocity from nozzle 68.

In the absence of an air/water mixture entering the second stage plenum 88 from the mixing tube and the air pressure was 30 psig in this plenum, then the air would be leaving in the 0.200 inch diameter exit tube 80 at close to sonic velocity, around 1100 ft/sec. This action is extremely effective in creating a homogeneous mixture of sub-micron sized ice crystals and cold air. Where the water droplets are introduced from the first mixing tube it is cooling and nucleation these droplets by the air which is at a high velocity and low static temperature in the mixing tube 80, which produces the tiny ice particle or "hard" nuclei.

This enhanced heat transfer together with the work done on the water particles which takes place in the mixing tube 80, is a most significant advantage of the method and apparatus of the present invention. The process takes advantage of the low static temperature created by the high velocity, the work done by accelerating the droplets up to speed, by performing the heat transfer between the air and the water droplets in the mixing tube 80 while the air is still travelling at a high rate of speed. The fact that the air and water are tubulent and the water is being broken up into droplets during its passage through the mixing tube 80 enhances the cooling effect since it creates a much greater water surface for the cold air to act upon.

In a first group of tests, nucleator 10 of FIGS. 1 and 2 was operated on one day at 16° ambient temperature and 70% humidity with 400 psi water supplied by line 24 and 30 psi air supplied by line 26 and on a later day at 21° ambient temperature, 70% humidity, 420 psi water pressure and 30 psi air pressure. In both tests, nucleator 10 made a fine frosty mist, totally frozen at 3 feet from the outlet of nucleator 10. It consumed approximately one quart of water per minute and 10 scfm of air. In another group of tests the nucleator 10 was substituted for the original nucleators on a Hedco air gun which made no snow until the nucleator 10 was turned on, at which time it started making good snow. It was switched on and off several times with the same results. The Hedco air gun normally is opened with eight high pressure prior art nucleators, thereby suggesting the possibility that the nucleator 10 of the present invention might replace several prior art high pressure nucleators.

Figure 4:
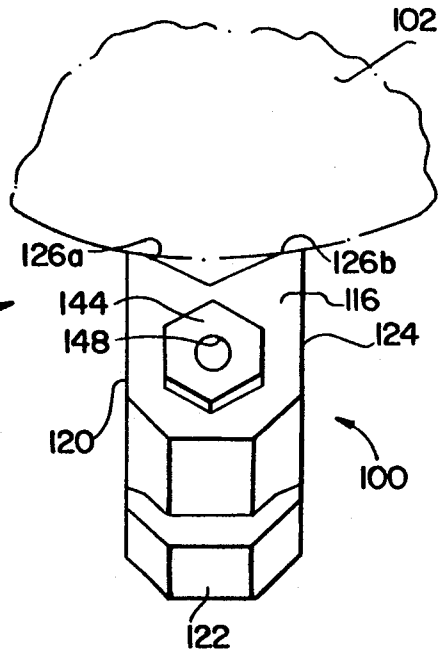
FIG. 4 is an end elevational view of the apparatus of FIG. 3.
Figure 3:
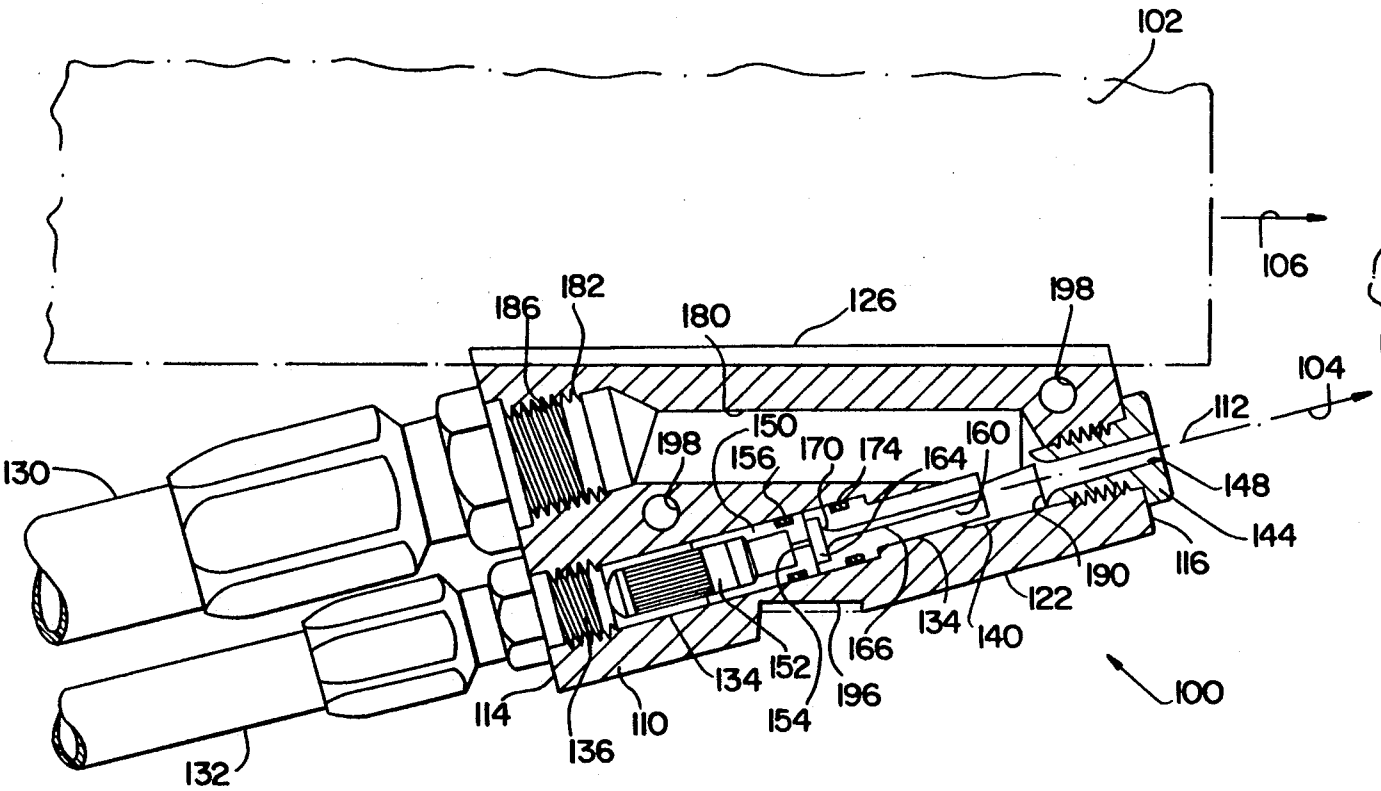
FIG. 3 is a longitudinal sectional view, partly diagrammatic, illustrating a nucleator gun according to another embodiment of the present invention as it would appear in combination with snow-making apparatus.

FIGS. 3 and 4 illustrate another form of the nucleator according to the present invention which is readily and easily installed on existing snow making apparatus, which allows maximum internal flow and avoids erosion of internal parts, and which is small in size, light in weight and includes easily interchangeable parts. Nucleator 100 is shown in operative association with snow making apparatus, the output portion of which is designated 102 in FIGS. 3 and 4. Nucleator gun 100 produces a stream of ice nuclei in the direction 104 which combines with the stream of air and water ejected from the snow making apparatus 102 into the atmosphere in the direction 106.

Nucleator 100 comprises a one-piece elongated body 110 of suitable material such as metal having a working axis 112 disposed parallel to the direction 104, inlet and outlet end surfaces 114 and 116, respectively, disposed substantially parallel to axis 112, side surfaces 102, 122 and 124 disposed substantially parallel to axis 112 and another surface 126 extending along a side of body 110 disposed at an angle to working axis 112. Surface 126 is adapted to contact a surface of snowmaking apparatus, for example apparatus 102 represented in FIGS. 3 and 4. The angle at which ice crystals from nucleator 100 are introduced to the output of the snowmaking apparatus. In addition, surface 126 includes portions **126*a*, and 123*b* disposed to define a V-shaped formation in endwise relation to body 110 as viewed in FIG. 4 the base of the V extending lengthwise along body 110. This formation enables nucleator 100** to be readily and easily installed on existing snow-making apparatus.

Nucleator 100, like nucleator 10 of FIGS. 1 and 2, operates with air supplied at a relatively low pressure, for example up to about 30 psig, for efficient and effective use with snow making apparatus which operates at a similar low pressure. Nucleator 100 has an outlet on end 116 and water and air inlets on end 114. In particular, low pressure air is supplied to nucleator 100 by a hose 130 and high pressure water is supplied to nucleator 100 by a hose 132, the hoses 130 and 132 being connected to the air and water supplies, respectively, associated with snow making apparatus 102.

Body 110 is provided with a longitudinal through bore or passage 134 extending between ends 114 and 116 and disposed with the longitudinal axis thereof coincident with working axis 112. The section of passage 134 adjacent body end 114 is threaded to receive a fitting 136 on the end of base 132. Passage 134 extends axially inwardly with a constant diameter whereupon it includes a relatively short smaller diameter portion which terminates at a relatively short smaller diameter portion which terminates at a relatively short larger diameter section 140. The remaining section of passage 134 extends to body end 116 and is threaded to receive a threaded, flanged bushing 144 having a constant diameter central through bore or passage 148.

A cup-like sleeve 150 is located in the larger diameter section of passage 134 and disposed with the open end facing inlet end 114 and with the closed end facing in the opposite direction. A filter means 152 is fitted in the open end of sleeve 150 and serves to screen out particulate matter. The closed end of sleeve 150 is provided with a small central aperture 154, having a diameter of 0.020 inch, which defines an orifice. An O-ring 156 is fitted in an annular groove in the outer surface of sleeve 150 to provide a fluid tight seal with the surface of passage 134.

A tubular element 160 is located in passage 134 between the closed end of sleeve 150 and the passage section 140. Element 160 has a first section of larger outer diameter which fits in the larger diameter section of passage 134 and a second, smaller diameter section which is received in the smaller diameter section of passage 134. The end of element 160 axially adjacent orifice 154 is provided with a recess 164 which defines a first chamber. A small diameter central bore or passage 160 extends axially from recess 164 to the opposite end of element 160. Passage 166 defines a first mixing tube and is provided at the inlet end with a smooth, annular surface 170 of gradually decreasing diameter in an inward axial direction. An O-ring 174 is fitted in an annular groove in the outer surface of element 160 to provide a fluid tight seal with the surface of passage 134.

Body 110 is provided with another passage 180 extending from passage section 140 toward inlet end 114 where it terminates in a threaded section 182 to receive a fitting 186 on the end of air hose 130. In the arrangement shown, passage 180 extends at an angle to passage 134 and is disposed substantially parallel to surface 126. As a result, low pressure air from hose 130 is introduced via passage 180 to passage section 140 which defines a second chamber in connection with the outlet of mixing tube 166.

Passage 148 of bushing 144 defines a second mixing tube having an inlet in communication with the second chamber 140 and having an outlet adjacent body end 116. Passage 148 is provided at the inlet end with a smooth, annular surface 190 of gradually decreasing diameter in an inward axial direction.

In operation, water at relatively high pressure, for example at least 300 psig or more, is introduced via hose 132. After passing through screen 152 the water enters orifice 154, which is about 0.020 inch diameter. This creates an aspirating jet which reduces the pressure in chamber 164, by jet pump action as the jet enters the rounded approach mixing tube 166. Since there is no inlet to chamber 164, the pressure therein approaches a vacuum. In the meantime, air at 30 psig is being introduced into chamber 140 via hose 130.

The lower pressure in chamber 164 plus the 30 psig pressure in chamber 140 creates a reverse flow of air through mixing tube 166 which combines with the water leaving jet orifice 154 to form a homogeneous mixture of water droplets and air. This reverse air flow takes place in the annular space between the water jet and the mixing tube 166. If any air is being admitted to chamber 140, it can only enter by reverse flow and the shearing action enhances the atomization of the water in mixing tube 166.

Finally, the air/water droplet mixture from the mixing tube 166 mixes with the 30 psig air introduced in chamber 140 as it enters a second mixing tube or exit tube 148. Here, it is further mixed and atomized and cooled by the expansion of the air in exit tube 148. Assuming that the 30 psig air enters chamber 140 at a temperature of +40° F., then the static air temperature in the mixing tube 148 in the absence of water injection will be approximately −36° F. This is based on the temperature drop resulting from decreasing the air pressure from 45 psia to 15 psia, plus a correction factor. Thus by the time the mixture leaves the exit tube 148 the water not only is finely atomized but is cooled during its passage down the exit tube by the −36° F. air, so that ice crystals are formed.

The diameters of mixing tubes 166 and 148 were found to bear a similar relation to the size of the jets entering them as the relationship of first and second stage mixing tubes in snowmaking apparatus 102 bears to the jets therein. In this connection, reference may be made to the above-noted pending application Ser. No. 271,163, the disclosure of which is hereby incorporated by reference. As a result, nucleator 100 was forced to operate satisfactorily when the diameters of mixing tubes 166 and 148 are 2.6 and 4.25 times, respectively, the diameter of the water jet from orifice 154 which is 0.020 inch.

The rounded inlets 170 and 190 to mixing tubes 160 and 148, respectively, correspond to conventional nozzle practice. This allows maximum flow in each mixing tube without a so-called vena contracta which is caused by a sharp edged orifice. It also prevents excessive erosion which would take place if the edge were sharp.

The nucleator body 110 is designed to create a simple, rugged, lightweight, one piece structure which can be fastened to the underside of any snow gun and the ice crystals are projected into the main plume at a shallow angle. The shallow "V" in the top surface 126 automatically aligns the nucleator 100 in the right direction and fits any diameter of snow gun. A groove 196 in the bottom surface of the nucleator provides for attaching it to the gun by a large diameter hose clamp. Alternately, two holes 189 are provided for attaching a bracket for special installations. The exit tube bushing 144 is easily interchangeable to smaller sizes for reducing air flow to prevent freeze up where ambient temperature is lower and less effective nucleation is required.

It is therefore apparent that the present invention accomplishes its intended objects. The method and apparatus of the present invention operates at relatively low pressure, for example, air at a pressure up to about 30 psig, in forming ice crystals for seeding an air-water mixture in making snow. The nucleation method and apparatus enhances the cooling effect of the air on the water droplets to produce very small ice particles. The nucleator apparatus allows maximum internal flow and avoids erosion of internal parts, is readily and easily installed and aligned on existing snowmaking apparatus, and is small in size, light in weight including easily interchangeable parts.

As will be apparent to persons skilled in the art, various modifications, adaptations and variations of the foregoing specific disclosure can be made without departing from the spirit and scope of this invention.

Having thus described the invention, what is claimed is:

1. Apparatus for forming ice crystals for seeding an air-water mixture in making snow comprising:

a) means for defining a first chamber;

b) means for defining a second chamber;

c) a first mixing tube having an inlet in fluid communication with said first chamber and an outlet in fluid communication with said second chamber;

d) a second mixing tube having an inlet in fluid communication with said second chamber and having an outlet;

e) means for introducing air at relatively low pressure to said second chamber;

f) aspirator means having an outlet in said first chamber; and g) means for supplying high pressure water to said aspiration means to provide a high speed jet of water for scavenging air from said first chamber and driving a mixture of air and water droplets along said first mixing tube and into said second chamber wherein said mixture is accelerated and cooled by the flow of low pressure air through said second chamber and along said second mixing tube so that an air-water particle mixture thus created is further cooled and broken down into a homogeneous mixture of small water droplets which are cooled in said second mixing tube by the air flowing therealong at a very low static temperature, thereby forming said ice crystals in the region of the outlet of said second mixing tube.

2. Apparatus according to claim 1, wherein the outlet of said aspirator means is spaced from the inlet of said first mixing tube.

3. Apparatus according to claim 1, wherein the outlet of said first mixing tube is spaced from the inlet of said second mixing tube.

4. Apparatus according to claim 1, wherein the outlet of said first mixing tube is on one end of said second chamber and the inlet of said second mixing tube is on an opposite end of said second chamber.

5. Apparatus according to claim 1, wherein each of said first and second mixing tubes is elongated and generally cylindrical and wherein the inner diameter of said first mixing tube is smaller than the inner diameter of said second mixing tube.

6. Apparatus according to claim 1, wherein the inlet of said first mixing tube is defined by a smooth annular surface of gradually decreasing diameter.

7. Apparatus according to claim 1, wherein the inlet of said second mixing tube is defined by a smooth annular surface of gradually decreasing diameter.

8. Apparatus according to claim 1, wherein each of said first and second mixing tubes is elongated and wherein said first mixing tube is longer than said second mixing tube.

9. Apparatus according to claim 1, wherein the outlet of said aspirator means is generally circular in cross-section and having an area, wherein each of said first and second mixing tubes has a longitudinal through passage which is generally circular in cross-section and having an area, and wherein the cross-sectional areas of said first and second mixing tubes are about 2.6 times and about 4.25 times, respeetively, the cross-sectional area of said aspirator means.

10. Apparatus according to claim 1, comprising a one-piece body containing said first and second chambers, said first and second mixing tubes and said aspirator means.

11. Apparatus according to claim 10, wherein said body is elongated and said aspirator means, said first and second chambers and first and second mixing tubes are located along a working axis of said body so that ice crystals are emitted from said body in a direction substantially along said working axis, and wherein said body has a surface disposed at an angle to aid working axis and adapted to contact a surface of snowmaking apparatus, said angle determining the angle at which ice crystals are introduced to the output of the snowmaking apparatus.

12. Apparatus according to claim 11, wherein said surface of said body is shaped to align said working axis in a predetermined manner upon contact between said surface of said body and the surface of the snowmaking apparatus.

13. A method of forming ice crystals for seeding an air-water mixture in making snow comprising the steps of:

a) introducing an aspirating jet of water to a first chamber in a manner reducing the pressure therein;

b) introducing low pressure air to a second chamber connected through a mixing tube to said first chamber;

c) utilizing the reduced pressure in said first chamber and the pressure of air in said second chamber to create a reverse flow of said low pressure air in said mixing tube;

d) combining said reverse flow of low pressure air with said jet of water to form a homogeneous mixture of water droplets and air in said mixing tube;

e) combining said mixture with more of said low pressure air in said second chamber and introducing the combination to a second mixing tube leading from said second chamber to an outlet; and f) said combination being mixed, atomized and cooled by expansion as it accelerates along said second mixing tube to form said ice crystals leaving said outlet.

14. A method according to claim 13, wherein air is introduced to said second chamber at a pressure up to about 30 psig.

* * * * *

UNITED STATES PATENT AND TRADEMARK OFFICE

CERTIFICATE OF CORRECTION

PATENT NO. : 5,083,707

DATED : January 28, 1992

INVENTOR(S) : Michael S. Holden

It is certified that error appears in the above—identified patent and that said Letters Patent is hereby corrected as shown below:

Column 1, line 39, wherein the word "of" should be --or--.

Column 2, line 21, wherein the word --is-- should be added to specification between the words "which readily".

Column 6, line 67, wherein the number "123b" should be --126b--.

Signed and Sealed this

Eighth Day of June, 1993

*Attest:*

Michael K. Kirk

MICHAEL K. KIRK

*Attesting Officer*

*Acting Commissioner of Patents and Trademarks*